US012076775B2

(12) United States Patent
Wang

(10) Patent No.: US 12,076,775 B2
(45) Date of Patent: Sep. 3, 2024

(54) METHOD FOR CHAMFERING INSTALLATION POSITION OF WATER CONTROL VALVE OF FAUCET BODY

(71) Applicant: Hsiang-Hung Wang, Changhua County (TW)

(72) Inventor: Hsiang-Hung Wang, Changhua County (TW)

( * ) Notice: Subject to any disclaimer, the term of this patent is extended or adjusted under 35 U.S.C. 154(b) by 398 days.

(21) Appl. No.: 17/709,377

(22) Filed: Mar. 30, 2022

(65) Prior Publication Data

US 2023/0311189 A1 Oct. 5, 2023

(51) Int. Cl.
*B21D 28/28* (2006.01)
*B21D 19/00* (2006.01)
*E03C 1/02* (2006.01)

(52) U.S. Cl.
CPC ..... *B21D 28/28* (2013.01); *B21D 19/005* (2013.01); *E03C 2001/026* (2013.01)

(58) Field of Classification Search
CPC .. B21D 28/28; B21D 19/005; E03C 2001/026
USPC ..... 83/869
See application file for complete search history.

(56) References Cited

U.S. PATENT DOCUMENTS 4,065,853 A * 1/1978 Lewandowski ..... B21D 28/28 30/361
4,220,106 A * 9/1980 Supik ..... C21D 9/08 219/652
5,492,001 A * 2/1996 Sasaki ..... B21D 19/005 72/359
7,685,690 B2 * 3/2010 Ghiran ..... B21D 28/28 228/2.3
11,878,380 B2 * 1/2024 Kitajima ..... F16L 41/14
2007/0261459 A1 * 11/2007 Jones ..... B21K 21/08 72/260
2016/0207088 A1 * 7/2016 Park ..... B23D 15/002
2020/0130041 A1 * 4/2020 Iiduka ..... B60R 22/18
2023/0079039 A1 * 3/2023 Yokota ..... B21D 28/28 83/54
2024/0100583 A1 * 3/2024 Otsuka ..... B21D 19/005

FOREIGN PATENT DOCUMENTS

EP 2987566 A1 * 2/2016 ..... B21D 19/005
EP 3156172 A1 * 4/2017
EP 1166925 A2 * 1/2022 ..... B21D 19/005

* cited by examiner

*Primary Examiner* — Omar Flores Sanchez
(74) *Attorney, Agent, or Firm* — Leong C. Lei

(57) ABSTRACT

A method for chamfering the installation position of a water control valve of a faucet body, mainly using a punching machine to drive a processing punch to punch a first end or second end, where the processing punch is provided with a fillet corresponding to the hole of the first end or second end, which squeezes the burrs through the driving of the punching machine, allowing the surface of installation position of the water control valve to be even and smooth, achieving smooth rotation of the water control valve, and preventing the water stop rubber to be scratched by the burrs or sharp corners.

5 Claims, 11 Drawing Sheets

METHOD FOR CHAMFERING INSTALLATION POSITION OF WATER CONTROL VALVE OF FAUCET BODY

(a) TECHNICAL FIELD OF THE INVENTION

The present invention relates to a method for processing a faucet body, and more particularly to a method for chamfering a water control valve installation position, capable of preventing a water control valve from being scratched by burrs or sharp corners through the technology of the present invention.

(b) DESCRIPTION OF THE PRIOR ART

As shown in FIG. 1, a faucet body is usually set to a T-shaped pipe structure, where the first end A thereof is to provide a connection with a water inlet pipe (end), the second end B a connection with a water outlet pipe (end), the third end C the assembly of a water control valve D, and the water control valve D is controlled to cause tap water to flow out toward one side of the water outlet pipe from the water inlet pipe. As shown in FIG. 2, the water control valve D is to close or open the first end A through a water stop rubber E, thereby introducing tap water or stopping water.

As shown in FIG. 3, since most of the faucet bodies are made of casting or forging molds, the straight holes at the first end A and the second end B are mostly processed by machines, and the burrs F or sharp corners left on the holes after the processing are needed to be deburred or removed, thereby preventing the burrs F or sharp corners from scratching the water stop rubber E.

As shown in FIGS. 4 and 5, at present, when removing the burrs F or sharp corners of the straight holes at the first end A and second end B of the faucet body, the sharp corners and burrs are removed (or the corners are trimmed and rounded) through a CNC tool machine with the hole lining tool G (as shown in FIG. 4) or a forming tool H (as shown in FIG. 5). However, the above technology has the following disadvantages:

1. as shown in FIG. 4, since the faucet body is a blank, there is a problem of eccentricity through the process of a CNC tool machine, being easy to have the problem of incomplete removal of burrs or sharp corners on one side, and further causing the water stop rubber E to be scratched by the burrs F.
2. if the technology shown in FIG. 5 is adopted, custom-made forming tools are required, which increases the tool cost and the manufacturing cost and time of the CNC tool machine.

SUMMARY OF THE INVENTION

The main object of the present invention is to provide a method for chamfering the installation position of a water control valve of a faucet body, mainly using a punching machine to drive a processing punch to punch a first end or second end, where the processing punch is provided with a fillet corresponding to the hole of the first end or second end, which squeezes the burrs through the driving of the punching machine, allowing the surface of installation position of the water control valve to be even and smooth, achieving smooth rotation of the water control valve, and preventing the water stop rubber to be scratched by the burrs or sharp corners.

For this reason, the present invention is achieved through the following technologies:

step 1: a faucet body blank being placed in a fixture, the faucet body being a T-typed pipe and including a first end and second end, the first end and second end including holes on the same axis as each other, and the faucet body being further provided with a third end allowing a water control valve to be installed thereon between the first end and second end;

step 2: a punching machine being provided with a processing punch including a connecting end and at least one forming end, the connecting end in connection with the punching machine, the forming end being configured on a bottom of the connecting end and an annular forming portion being provided on a connection thereof with the connecting end, and the forming end being able to penetrate the hole of the first end or second end; and step 3: the punching machine driving the processing punch to move toward the hole of the first end or second end, and the forming portion of the forming end squeezing a periphery of the hole of the first end or second end to remove burrs or sharp corners on the hole.

According to the above method, the forming end is a rounded corner.

According to the above method, the forming portion is a chamfer.

According to the above method, the forming end includes a first processing portion corresponding to the first end and a second processing portion corresponding to the second end, a connection of the first processing portion with the connecting end is provided with a first forming portion, a connection of the second processing portion with the connecting end a second forming portion, the punching machine drives the processing punch to move toward the first end and second end to remove burrs or sharp corners on the holes of the first end and second end.

The present invention has the following advantages compared to the prior arts:

1. the present invention improves the method for processing the burrs or sharp corners on the hole of the first end and the hole of the second end of the faucet body, which not only can speed the processing but reduce costs.
2. according to the present invention, the burrs or sharp corners are removed by means of the squeeze of the forming portion of the forming end, so that the burrs on the holes can be removed as long as the processing position of the processing punch is correct and the holes at the two sides are allowed to be kept consistent smoothness, allowing the water stop rubber on the water control valve to be used smoothly and not to be scratched by the burrs.

DETAILED DESCRIPTION OF THE PREFERRED EMBODIMENTS

Figure 1:
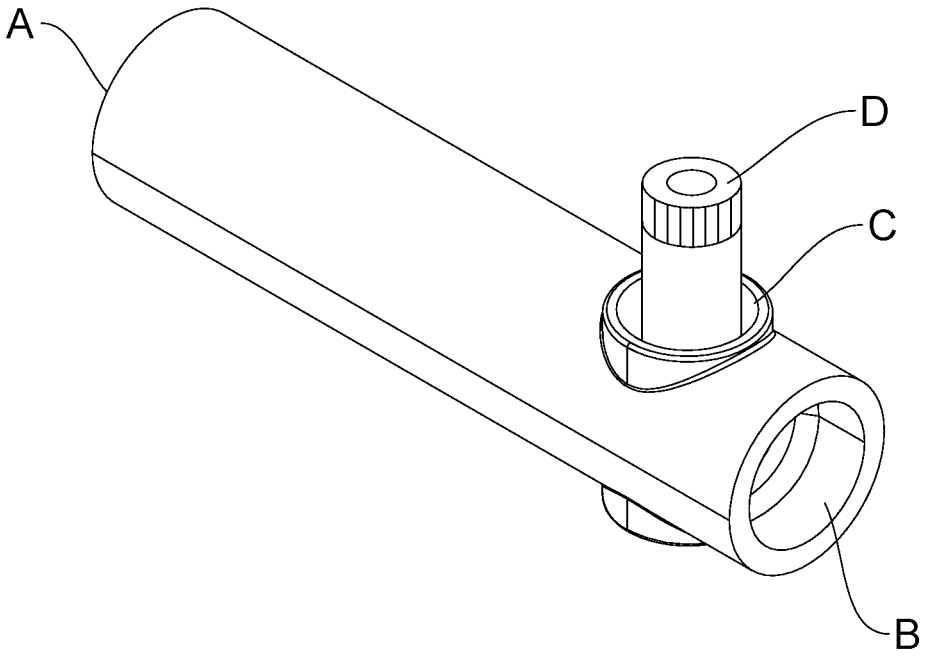
FIG. 1 is a perspective view of the structural configuration of a faucet body.
Figure 2:
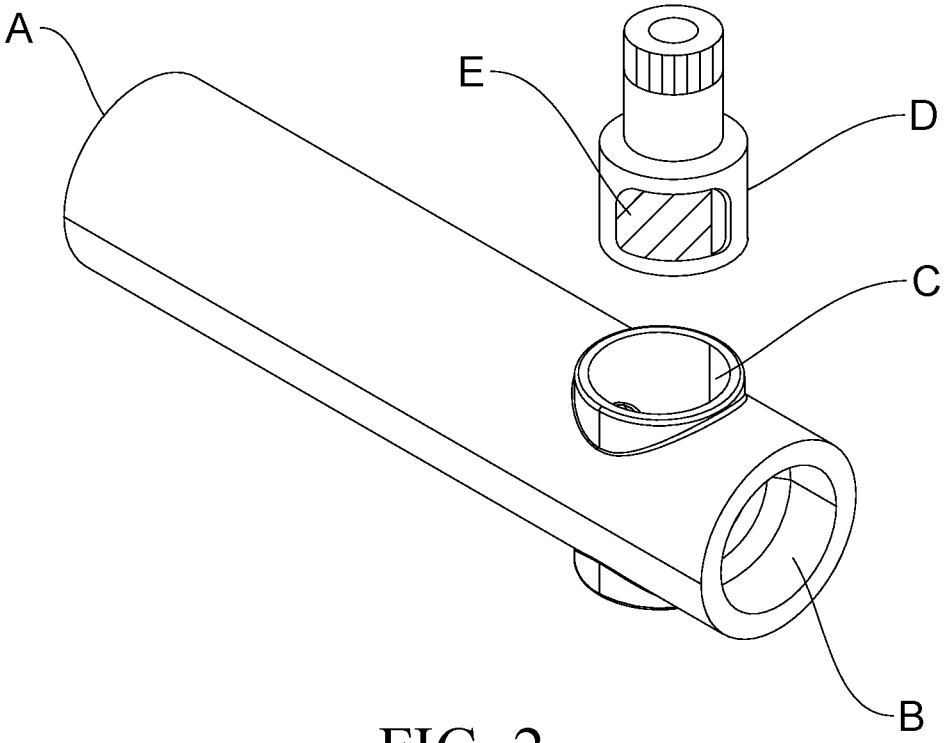
FIG. 2 is an exploded view of the structure of the faucet body.
Figure 3:
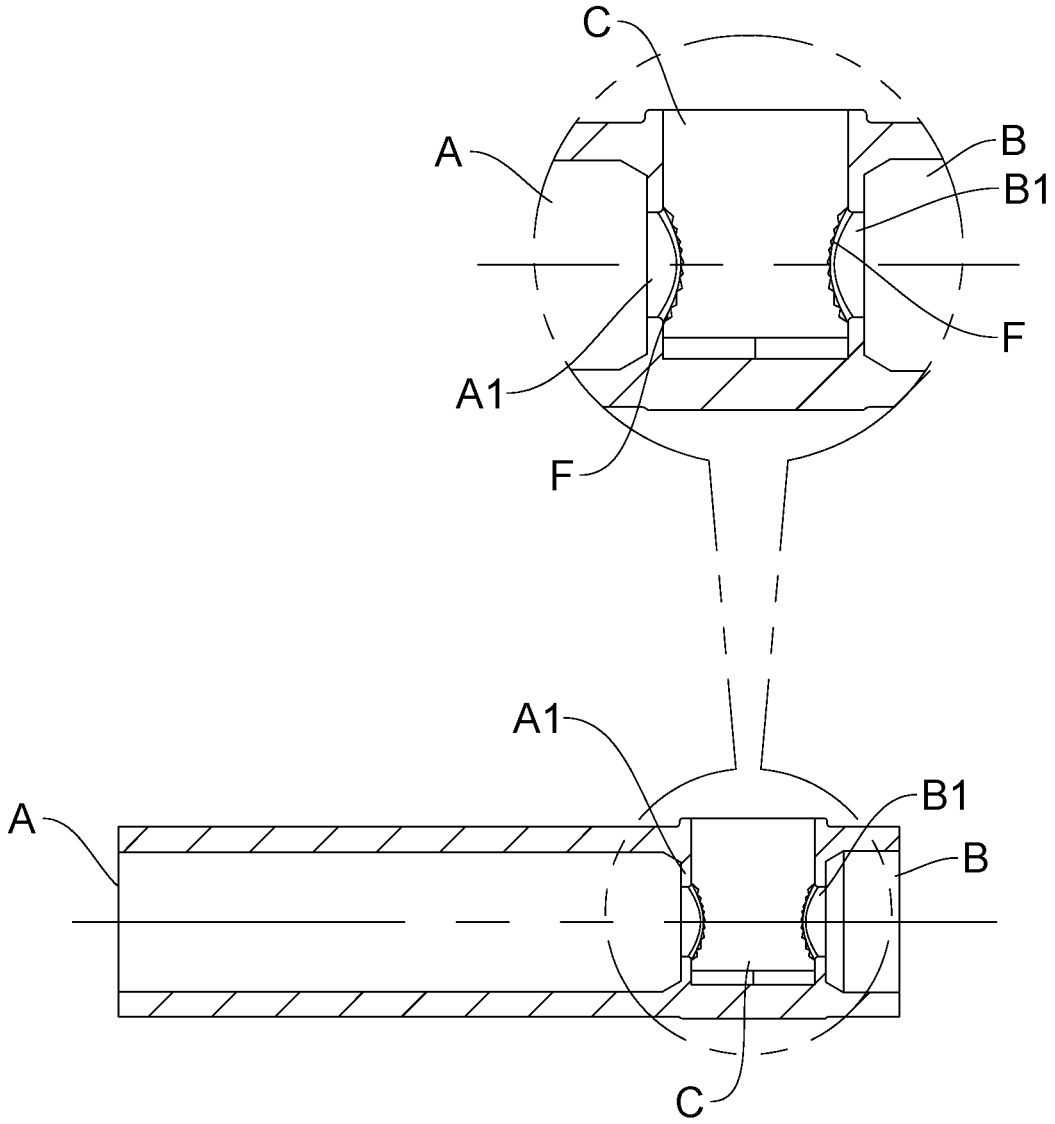
FIG. 3 is a schematic view of the unprocessed faucet body.
Figure 4:
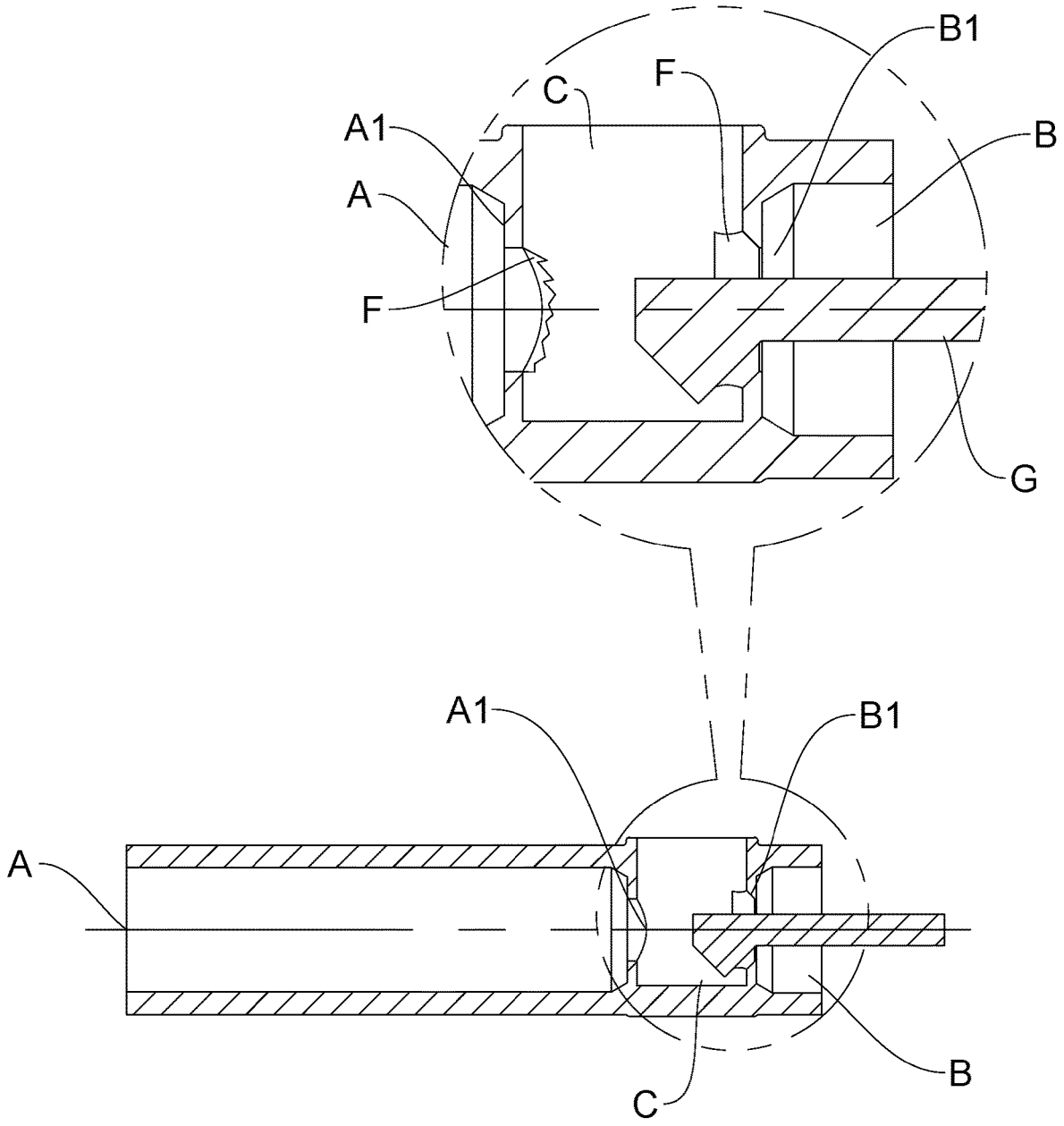
FIGS. 4 and 5 respectively are a schematic view of the faucet body processed by a CNC machine.
Figure 5:
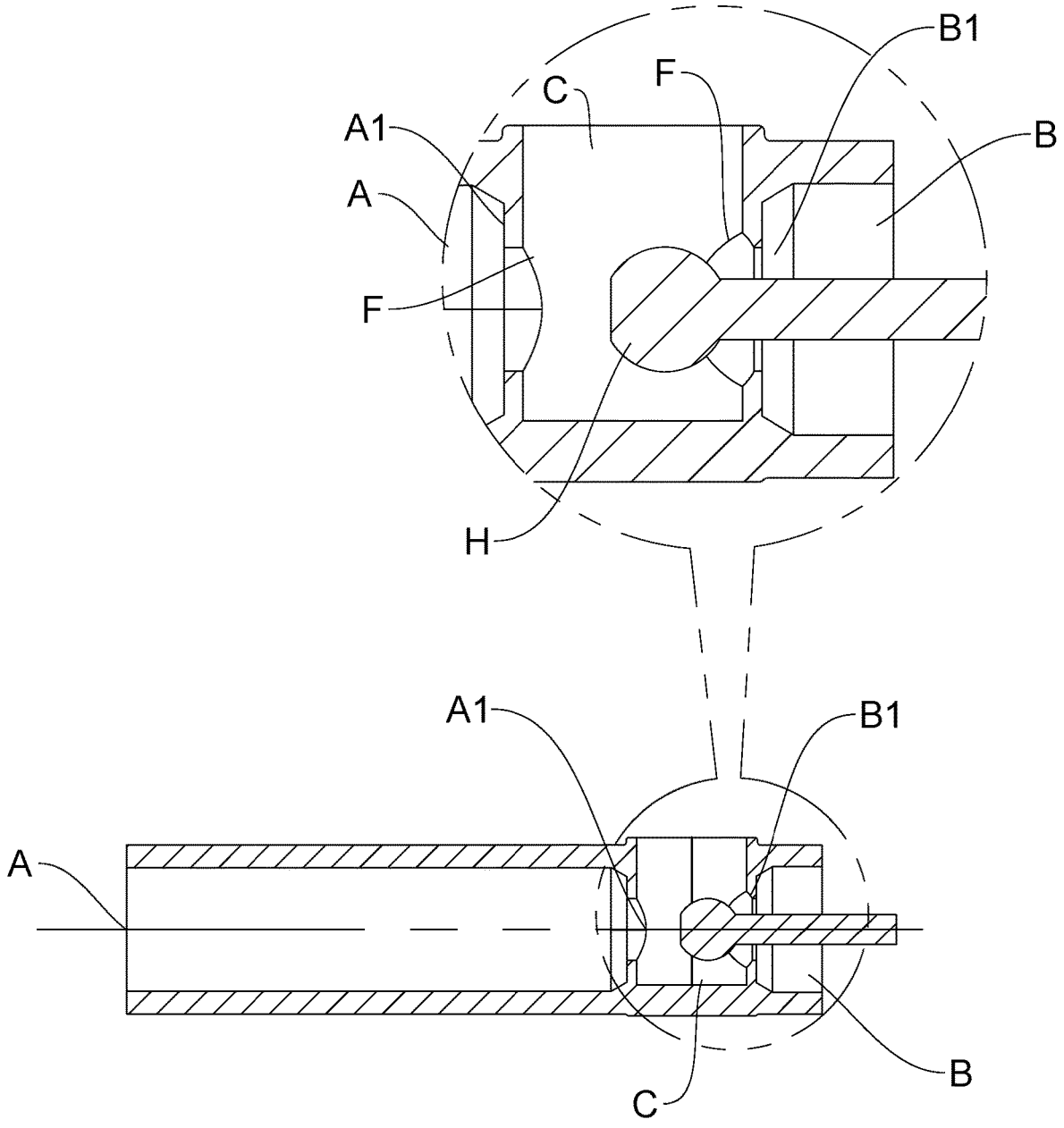
Figure 6:
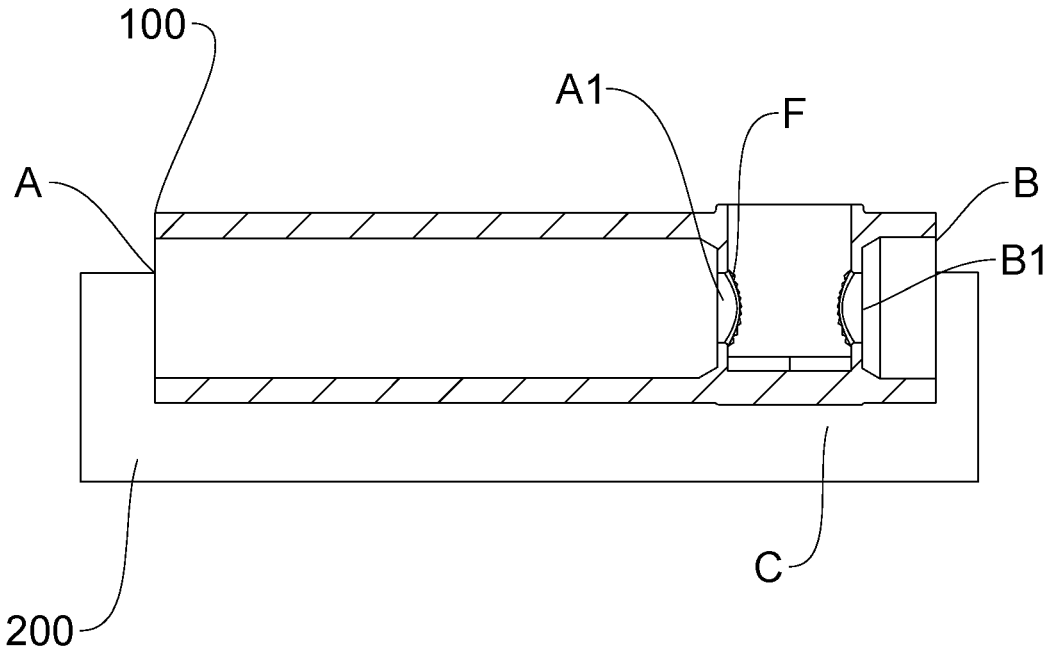
FIG. 6 is a schematic view of the present invention, where a processing step 1 is being carried out.
Figure 7:
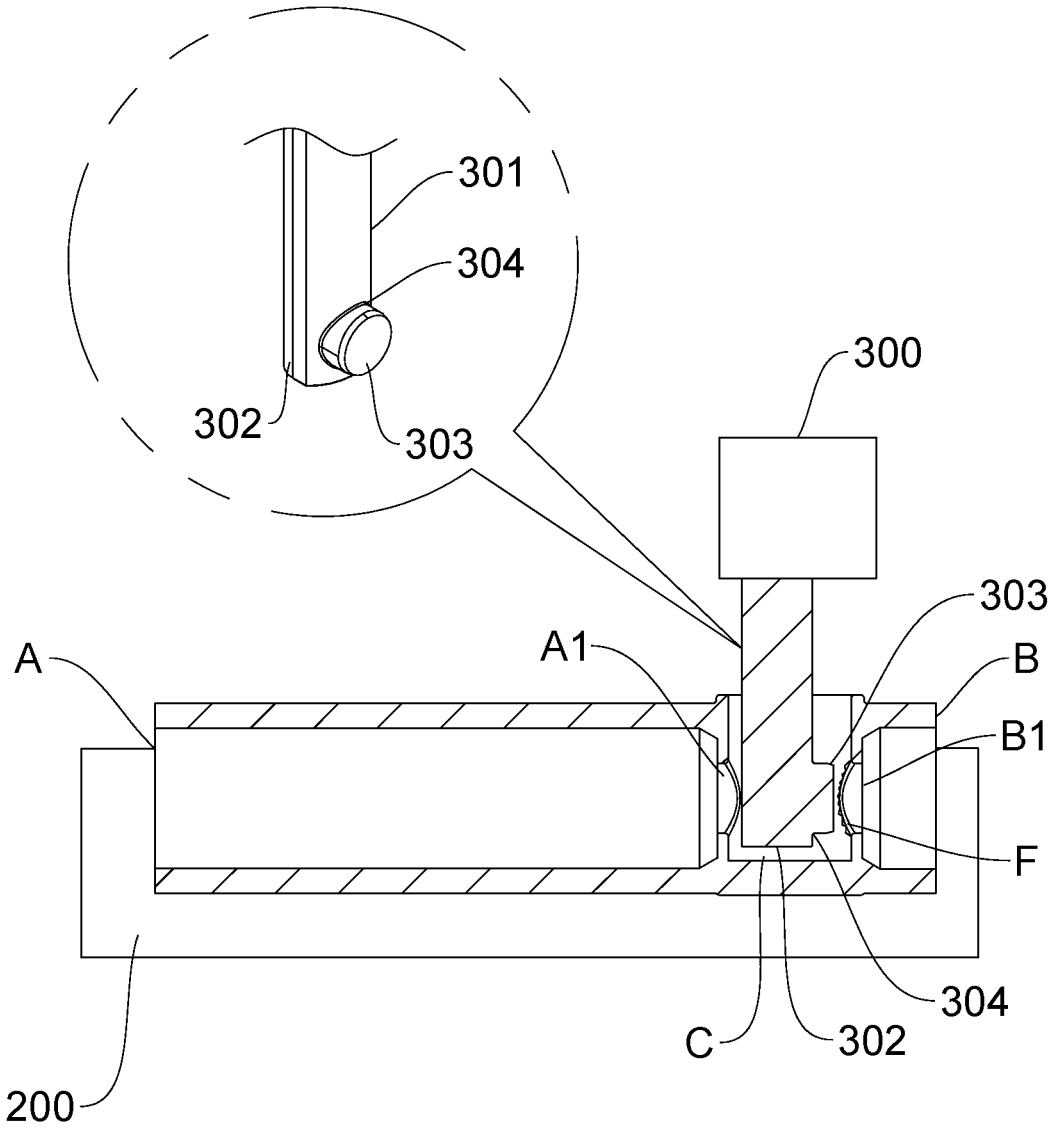
FIG. 7 is a schematic view of the present invention, where a processing step 2 is being carried out.
Figure 8:
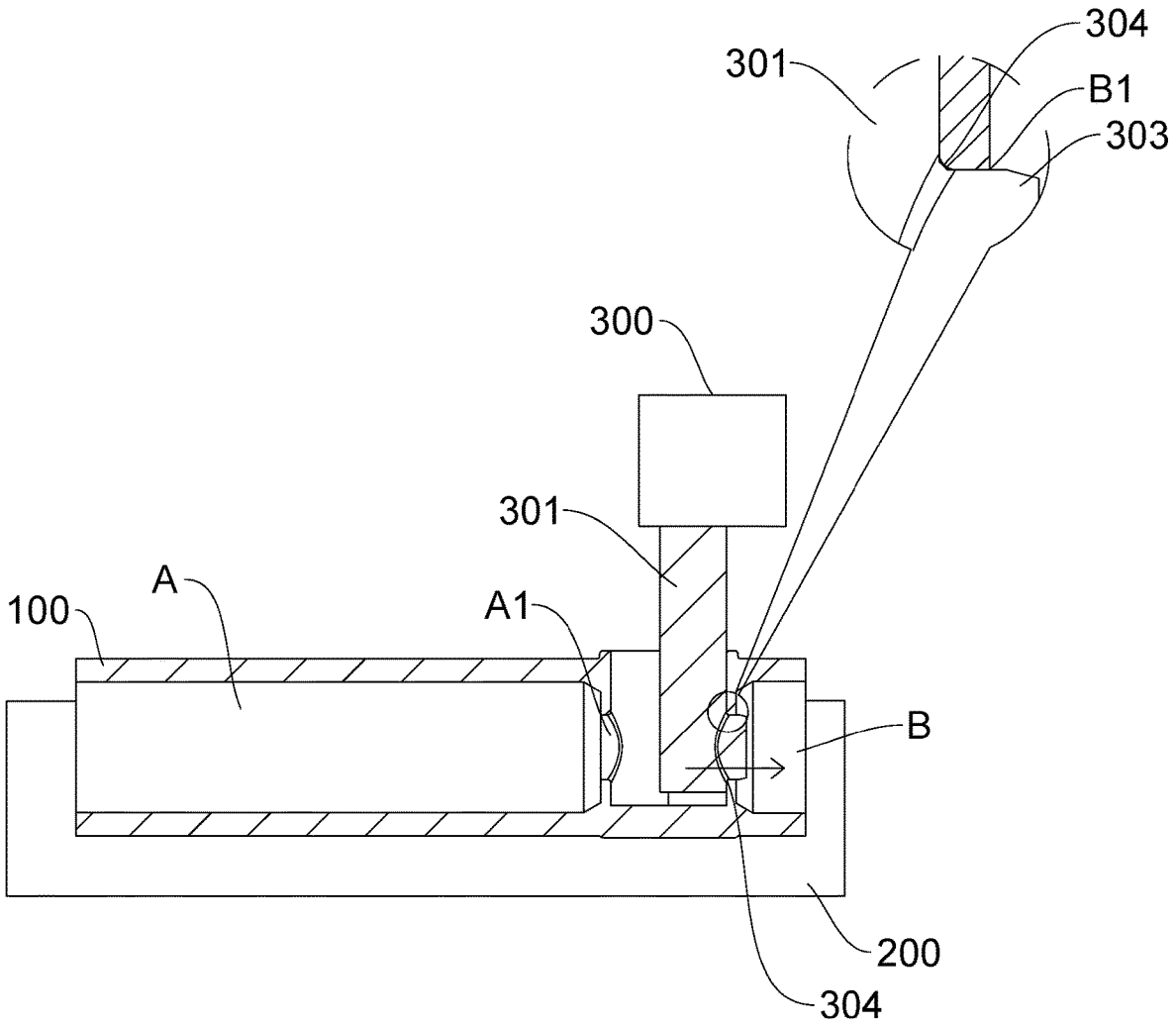
FIG. 8 is a schematic view of the present invention, where a processing step 3 is being carried out.
Figure 9:
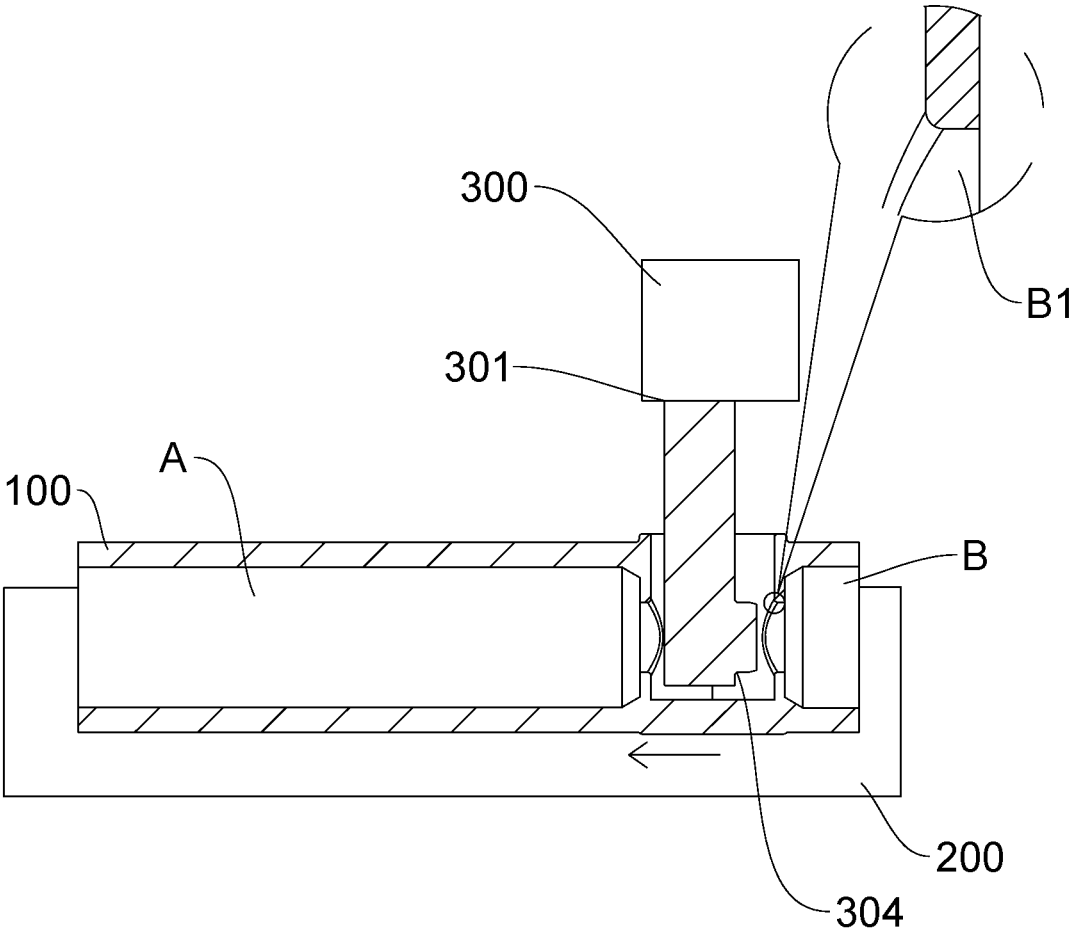
FIG. 9 is a schematic view of removing burrs in FIG. 8.

Referring to FIGS. 6 to 8, a method for chamfering the installation position of a water control valve of a faucet body of the present invention mainly includes the following steps:

Step 1: as shown in FIG. 6, the blank of a faucet body 100 being placed in a fixture 200, where the faucet body 100 is a T-typed pipe, including a first end A and second end B including holes A1 and B1 on the same axis as each other, and a third end C between the first end A and second end B is further provided on the faucet body 100, where the third end C provides a water control valve D (as shown in FIGS. 1 and 2), since the water control valve D is not the focus of the improvement in the present invention, the detail thereof is omitted here, where the faucet body 100 is made of copper (brass, bronze, lead-free copper, free-cutting copper) belonging to soft metals in metal property and being easy to be processed;

Step 2: as shown in FIG. 7, a punching machine 300 being provided with a processing punch 301 including a connecting end 302 and forming end 303, the connecting end 302 being connected with the punching machine 300, and the forming end 303 being configured on the bottom of the connecting end 302 and provided with an annular forming portion 304 on the connection of the forming end 303 with the connecting end 302, the forming end 303 can penetrate the hole A1 of the first end A or the hole B1 of the second end B, where the punching machine 300 may be a horizontal punching machine or a toggle-type punching machine, and mainly drives the processing punch 301 toward the first end A or the second end B side in a manner of driving in a plane direction; and Step 3: as shown in FIGS. 8 and 9, the punching machine 300 driving the processing punch 301 to move toward the first end A or second end B (the figures show a single direction as an illustration), and the forming portion 304 of the forming end 303 being pressed against the hole A1 of the first end A or the hole B1 of the second end B and the forming portion 304 being used to further squeeze and remove the burrs F on the hole A1 or B1 as FIG. 9 shows; since the faucet body 100 is made of soft metal, the burrs F or the sharp corners being capable squeezed and removed without the need for a punching machine 300 with an excessively large tonnage. It is worth to mentioned that the forming portion 304 can use chamfers or fillets to process the holes A1 and B1, so as to make the peripheries of the holes A1 and B1 even and smooth.

Figure 10:
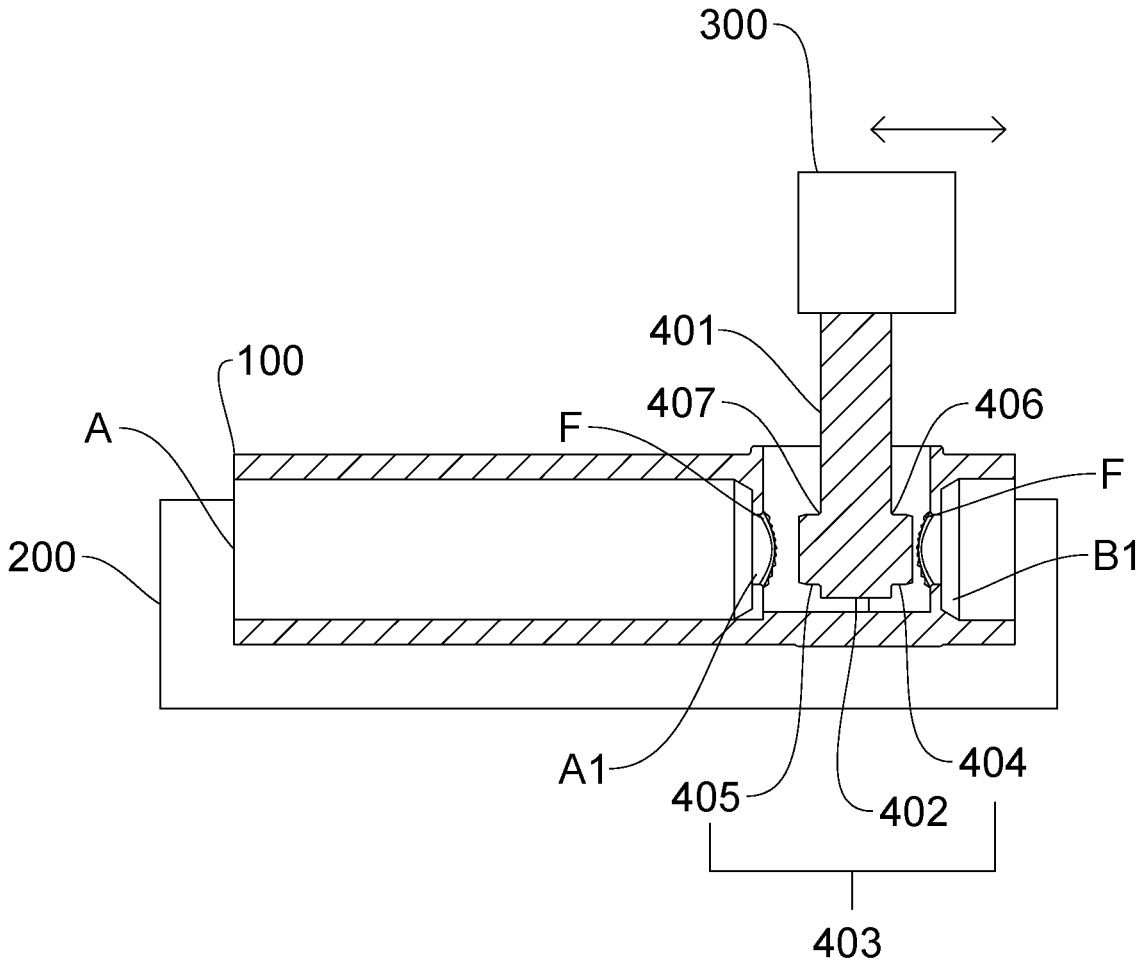
FIG. 10 shows schematic view of a first end and second view processed in sequence through the method of the present invention.
Figure 11:
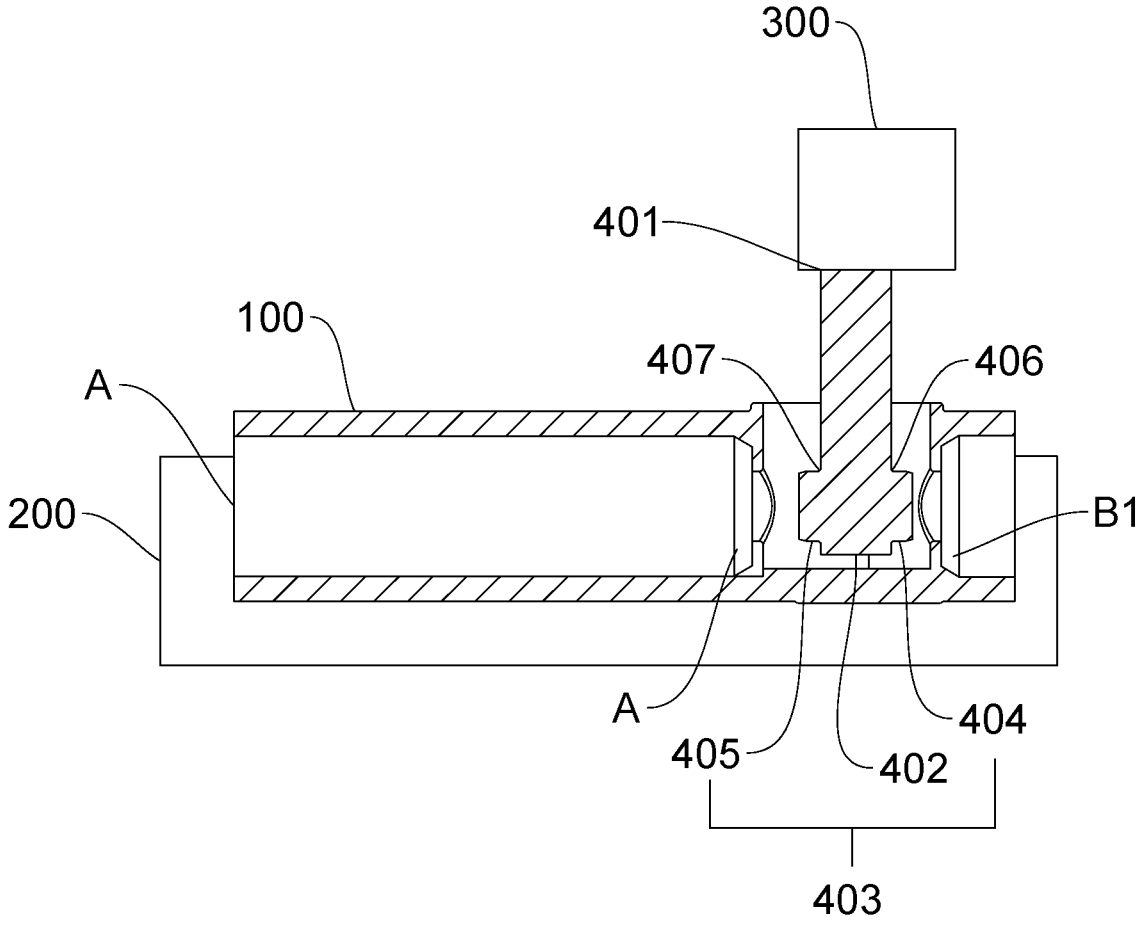
FIG. 11 is a schematic view of removing burrs in FIG. 10.

Referring to FIGS. 10 and 11, a processing punch 401 used in another preferred embodiment of the present invention is derived from the one shown in FIGS. 7 and 8, having a T-shaped structure. A forming end 403 includes a first processing portion 404 corresponding to the first end A and a second processing portion 405 corresponding to the second end B; a first forming portion 406 is provided on the connection of the first processing portion 404 with a connecting end 402, and a second forming portion 407 the connection of the second processing portion 405 with the connecting end 402. Whereby, a punching machine 400 drives the processing punch 401 to push against the first end A and the second end B to remove the burrs F on the hole A1 of the first end A and the hole B1 of the second end B, so that the burrs on the first end A and second end B can be processed in one punching operation.

Through the above description, the present invention has the following advantages compared to the prior arts:

1. the present invention improves the method for processing the burrs or sharp corners on the hole A1 of the first end A and the hole B1 of the second end B of the faucet body 100, which not only can speed the processing but reduce costs.

according to the present invention, the burrs F or sharp corners are removed by means of the squeeze of the forming portion 304 of the forming end 303, so that the burrs on the holes A1 and B1 can be removed as long as the processing position of the processing punch 301 is correct and the holes A1 and B1 at the two sides are allowed to be kept consistent smoothness, allowing the water stop rubber E on the water control valve to be used smoothly and not to be scratched by the burrs F.

I claim:

1. A method for chamfering the installation position of a water control valve of a faucet body, comprising:

step 1: a faucet body blank being placed in a fixture, said faucet body being a T-typed pipe and comprising a first end and second end, said first end and second end comprising holes on the same axis as each other, and said faucet body being further provided with a third end allowing a water control valve to be installed thereon between said first end and second end;

step 2: a punching machine being provided with a processing punch comprising a connecting end and at least one forming end, said connecting end in connection with said punching machine, said forming end being configured on a bottom of said connecting end and an annular forming portion being provided on a connection thereof with said connecting end, and said forming end being able to penetrate said hole of said first end or second end; and step 3: said punching machine driving said processing punch to move toward said hole of said first end or second end, and said forming portion of said forming end squeezing a periphery of said hole of said first end or second end to remove burrs or sharp corners on said hole.

2. The method according to claim 1, wherein said forming end is a rounded corner.

3. The method according to claim 1, wherein said forming portion is a chamfer.

4. The method according to claim 1, wherein said forming end comprises a first processing portion corresponding to said first end and a second processing portion corresponding to said second end, a connection of said first processing portion with said connecting end is provided with a first forming portion, a connection of said second processing portion with said connecting end a second forming portion, said punching machine drives said processing punch to move toward said first end and second end to remove burrs or sharp corners on said holes of said first end and second end.

5. The method according to claim 1, wherein said faucet body is made of soft metal.

* * * * *